US009345915B2

(12) United States Patent
Bouthors et al.

(10) Patent No.: US 9,345,915 B2
(45) Date of Patent: May 24, 2016

(54) EQUIPMENT FOR CONTROLLING A TRAIN FIRE IN A LONG RAILWAY TUNNEL AND METHOD FOR IMPLEMENTING SAME

(75) Inventors: Bruno Bouthors, Calais (FR); Pascal Hochart, Marck (FR); François Levert, Calais (FR); Christian Maquaire, Neuchatel-Hardelot (FR); Vincent Massy, Leulinghen Bernes (FR); Serge Poncet, Calais (FR)

(73) Assignee: France-Manche, Paris (FR)

( * ) Notice: Subject to any disclaimer, the term of this patent is extended or adjusted under 35 U.S.C. 154(b) by 1110 days.

(21) Appl. No.: 13/378,558

(22) PCT Filed: May 27, 2010

(86) PCT No.: PCT/FR2010/051023

§ 371 (c)(1),
(2), (4) Date: Apr. 17, 2012

(87) PCT Pub. No.: WO2010/146267

PCT Pub. Date: Dec. 23, 2010

(65) Prior Publication Data

US 2012/0193110 A1 Aug. 2, 2012

(30) Foreign Application Priority Data

Jun. 17, 2009 (FR) ..... 09 54079
Aug. 21, 2009 (FR) ..... 09 55725

(51) Int. Cl.

| | |
|---|---|
| ***A62C 37/00*** | (2006.01) |
| ***A62C 3/07*** | (2006.01) |
| ***A62C 3/02*** | (2006.01) |
| ***B61L 3/00*** | (2006.01) |
| ***B61L 25/02*** | (2006.01) |
| ***B61L 27/00*** | (2006.01) |

(52) U.S. Cl.

CPC ..... *A62C 3/07* (2013.01); *A62C 3/0221* (2013.01); *B61L 3/008* (2013.01); *B61L 25/025* (2013.01); *B61L 27/0088* (2013.01)

(58) Field of Classification Search

CPC ..... B61L 25/02; B61L 25/025; A62C 2/24; A62C 3/0221; A62C 3/07; A62C 37/04; A62C 37/36

USPC ..... 169/56, 60, 61, 62, 16

See application file for complete search history.

(56) References Cited

U.S. PATENT DOCUMENTS 5,915,480 A * 6/1999 Yemelyanov et al. ..... 169/61
6,634,432 B2 * 10/2003 Sundholm ..... 169/16

(Continued)

FOREIGN PATENT DOCUMENTS

DE 10037921 A1 2/2002
DE 10241113 A1 3/2004

(Continued)

OTHER PUBLICATIONS

Office of Rail Regulation, Safe Movement of Trains, 2006, Railway Safetey Pbulication 3, p. 34-35.*

*Primary Examiner* — Arthur O Hall
*Assistant Examiner* — Viet Le
(74) *Attorney, Agent, or Firm* — Drinker Biddle & Reath LLP

(57) ABSTRACT

The invention relates to equipment including fixed fire detectors (10) along the track (100) and fixed extinguishing stations (20) installed in the tunnel. Each station is provided with fire detectors (23) for locating the source, an automatic configuration system for targeting the area to be sprayed, individually controlled spraying devices (22), and a device for remotely or locally activating the spray. The station is preceded by a train stopping area (ZA) in which the train (TRO) starts a stopping sequence and slows down from the safety speed thereof to the zero speed thereof. A control center (30) manages the operation of the equipment and in particular orders a reduction of the train (TRO) running speed when the detectors (10) have detected a fire (flames, smoke, CO). The reduced speed (safety speed (Vs)) enables the train (TRO) to run as quickly as possible while mitigating the progression of the fire.

12 Claims, 4 Drawing Sheets

(56) References Cited

U.S. PATENT DOCUMENTS

Figure 1:
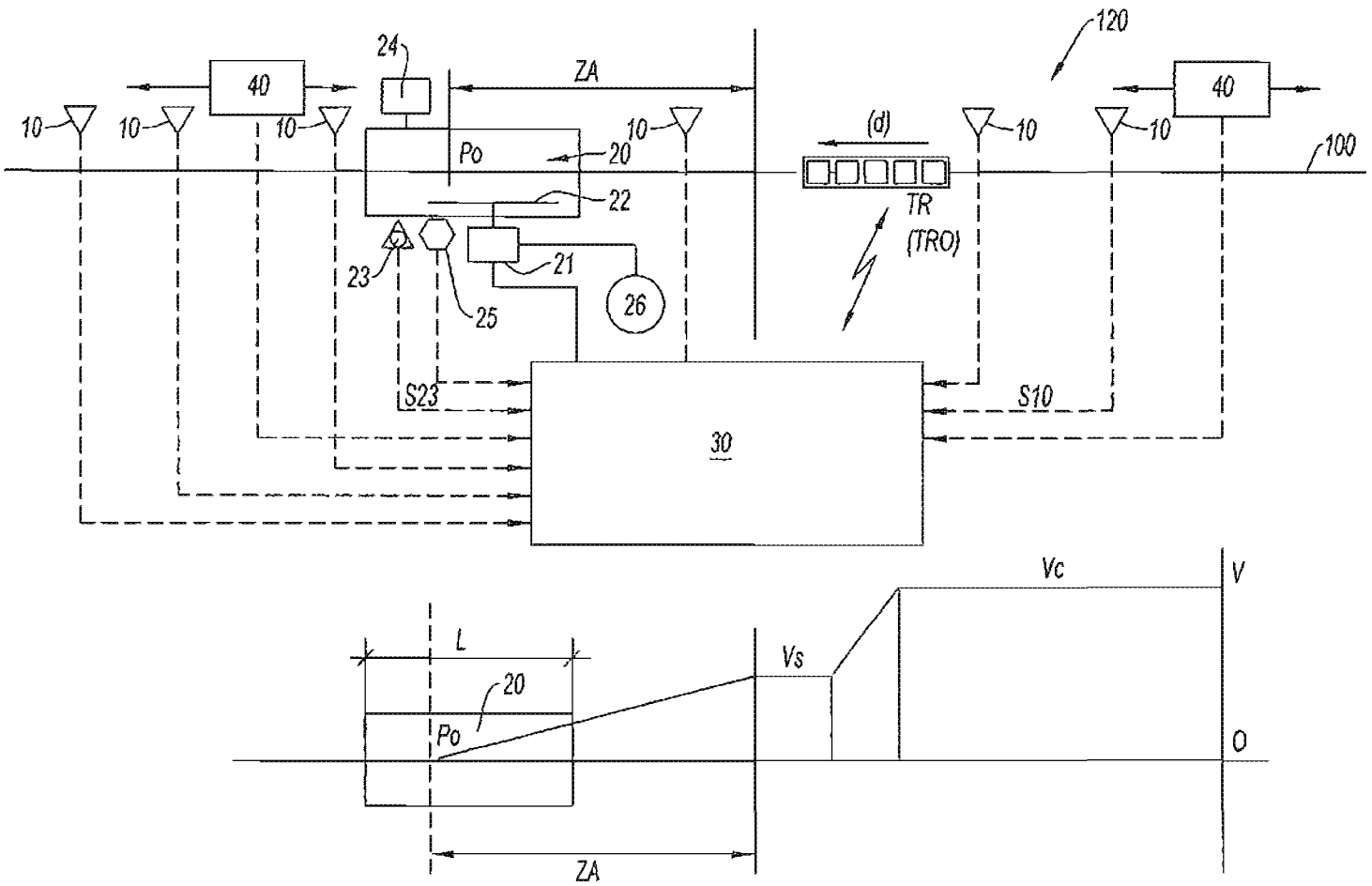

| | | | | |
|---|---|---|---|---|
| 2002/0117311 | A1 | 8/2002 | Sundholm | |
| 2009/0042504 | A1 * | 2/2009 | Kumm et al. | 454/167 |

FOREIGN PATENT DOCUMENTS

| | | | |
|---|---|---|---|
| EP | 1060766 | B1 * | 1/2004 |
| WO | WO2009/156583 | A1 | 12/2009 |

* cited by examiner

EQUIPMENT FOR CONTROLLING A TRAIN FIRE IN A LONG RAILWAY TUNNEL AND METHOD FOR IMPLEMENTING SAME

FIELD OF THE INVENTION

The present invention relates to equipment for controlling a train fire in a long railway tunnel, in particular a train such as a shuttle transporting vehicles and in particular heavy goods vehicles.

PRIOR ART

There are various methods of controlling a train fire in a long railway tunnel. These methods generally entail managing the running of trains upstream and downstream of the train which is on fire and gaining access to the train which is on fire either via the railway tunnel or also via the service tunnel. These methods of controlling a tire are, however, traditional methods whose main drawback is that they take a very long time to implement, for instance an hour or so in a very long tunnel, which enables the fire to reach its full height and cause major damage not just to the train but also to the tunnel infrastructure.

This damage is especially serious as its repair is a long and tricky operation because of access conditions to the repair site and because of the consequences of a partial or complete shutdown of the tunnel.

These fire problems occur in particular in long railway tunnels, i.e. whose length does not make it possible for a train on which a fire has started to continue to run in the hope of reaching the tunnel exit so that the fire can then be extinguished.

OBJECT OF THE INVENTION

The object of the present invention is to develop methods by which the time taken to act on a fire in a train in a long railway tunnel, in particular a train loaded with vehicles such as heavy goods vehicles, can be substantially reduced and the fire very rapidly controlled in order to limit damage to both the train and the tunnel infrastructure.

STATEMENT AND ADVANTAGES OF THE INVENTION

The invention therefore relates to equipment of the type described above, characterized in that it comprises:

A. a set of fixed fire detectors installed along the track throughout the tunnel, and a set of fire detectors installed on board trains, B. at least one fixed extinguishing station, installed in the tunnel over a length at least equal to the length of a train, and comprising extinguishing equipment formed by devices for spraying an extinguishing fluid, these devices being controlled individually and distributed over the length of the extinguishing station, C. a set of fire detectors installed along the station in order to detect the source of a fire in a train and locate it, D. a train stopping area, upstream of the extinguishing station, in which the detected train slows down to its zero speed so that it can be stopped in a precise position in the extinguishing station, E. a control centre, connected to the fixed detectors (flames, smoke, CO) in the tunnel and to the fixed detectors (temperature) of the extinguishing station in order to receive the fire signals so as to:

monitor the fire information which is confirmed by reconciling the signals received and/or information from an onboard fire alarm, order a reduction of the speed of the train from its normal running speed to a reduced safety speed, order the train to stop in the next available extinguishing station, detect the position of the source of the fire in the train and automatically configure the extinguishing fluid spray devices with respect to the source and its surrounding areas, the devices being activated by remote or local control.

The equipment of the invention comprises one and generally at least two extinguishing stations since a long tunnel comprises a tube for trains running in one direction and a tube for trains running in the other direction with the result that the equipment may be advantageously linked for both tunnels as they are substantially the same length.

The equipment makes it possible very rapidly, within the space of a few minutes, to control the start of a fire or a fire which has already broken out, while preventing the fire from developing from its initial stage after its detection, by running the train at its safety speed and then profiting, from exceptional conditions in order to control the fire by means of a mist of high-pressure extinguishing fluid and in particular a mist of water. This mist is advantageously confined and concentrated on the area which is on fire in order to prevent excessive damage and in particular in order to be able more readily to target the fire and extinguish it as rapidly as possible. This highly localized action on a source which is itself localized makes it possible effectively to control the fire while consuming quantities of water compatible with the very particular situation of the extinguishing station in a long tunnel, at locations at which relatively limited reserves of water are available or whose water supply is provided at relatively limited rates of flow. Lastly, the reduction of the quantities of water used prevents secondary and often major damage to the location at which the intervention takes place.

Management of the air flow volume in the railway tunnel following the activation of the ventilation station (during the train stopping phase) to remove the smoke in order to protect the passengers on a train in which the source of a fire has been detected makes it possible to reduce the speed at which the fire develops and propagates in the train in the extinguishing station.

According to a further feature, the extinguishing fluid is water containing, where appropriate, an extinguishing agent which is sprayed in the form of a mist of water over the section of the train which is on fire and surrounding sections in the extinguishing station; curtains of water, one at the front and one at the rear of the train, and a third at the centre of the station, may also be activated by remote or local control.

According to a further feature, the extinguishing station is equipped with a plurality of extinguishing fluid spray rails, each rail belonging to an individually controlled extinguishing device, so as to spray extinguishing fluid only on the source of the fire and on three or four adjacent areas detected by the automatic devices in order to contain the fire.

Providing the extinguishing devices in the form of a rail therefore makes it possible separately to treat a certain length of the train while facilitating the separate control of the various rail lengths in order to target the source of the fire as efficiently as possible.

According to a further feature, the extinguishing station is equipped with a fire location system comprising detectors and cameras in order to detect the position of the source of the fire in the train and provide a camera image, in particular infrared, of the fire source.

The location of the source of the fire takes place in the extinguishing station and the extinguishing means are controlled as a function of this precise location.

According to a further feature, the tunnel comprises two tubes through which trains run in one direction and in the other direction, each of these tubes being equipped at substantially the same location with an extinguishing station.

According to a further feature, the equipment comprises a decentralized manual control post in the vicinity of an extinguishing station in order to be able to intervene manually and take direct control of the extinguishing systems.

The invention also relates to a method of controlling a train fire in a long railway tunnel, characterized in that the trains are detected as they pass in front of fire detectors in the tunnel (flames, smoke, CO) and/or if the onboard fire detection equipment on a train is triggered and then reported by the driver, the fire signal transmitted by the fixed detectors and/or by the driver is checked, and the detected train is ordered to run at the safety speed to stabilise the source of the fire and/or curb its progression.

According to this method, it is particularly advantageous when, after the train is running at its safety speed,

- the driver is ordered to stop the train at the next extinguishing station,
- when the train has stopped, the system detects the fire source in the extinguishing station and automatically configures the extinguishing area for the fire source and a predetermined train length surrounding the source,
- the extinguishing means of the extinguishing station are activated by remote or local control,
- by way of summary, as a result of the detection of a source of a fire, the beginning of a fire or a sign showing that a fire is starting on a train, the invention makes it possible to manage the operation of the train to prevent rapid propagation of the fire in the train which can reach an extinguishing station integrated in the tunnel in order very rapidly, after the fire has been detected, to treat the fire in this extinguishing station, thereby preventing any risk of fire spreading throughout the train and the substantial damage which would be caused to the tunnel infrastructure.

DRAWINGS

Figure 2:
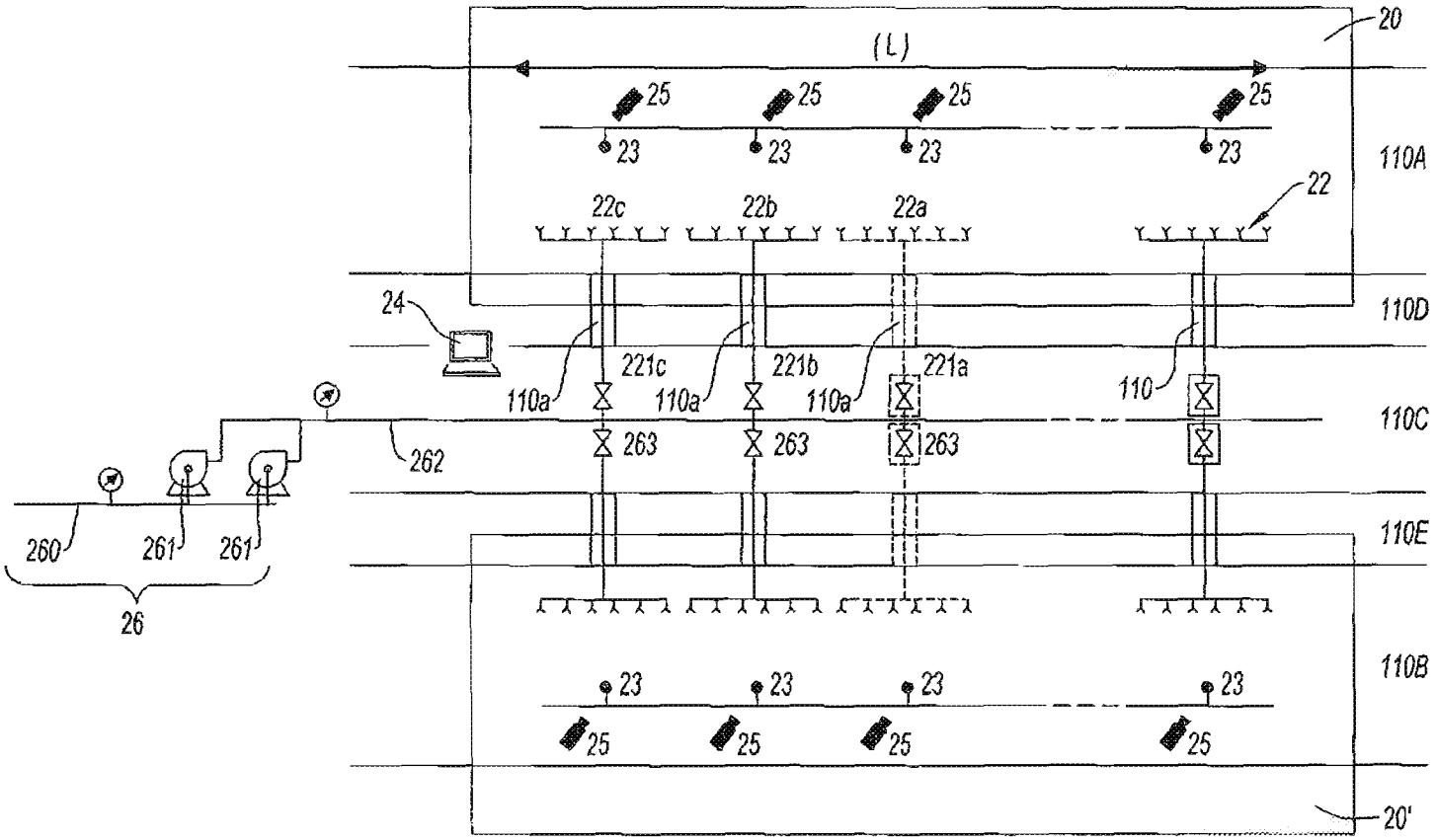
Figure 3:
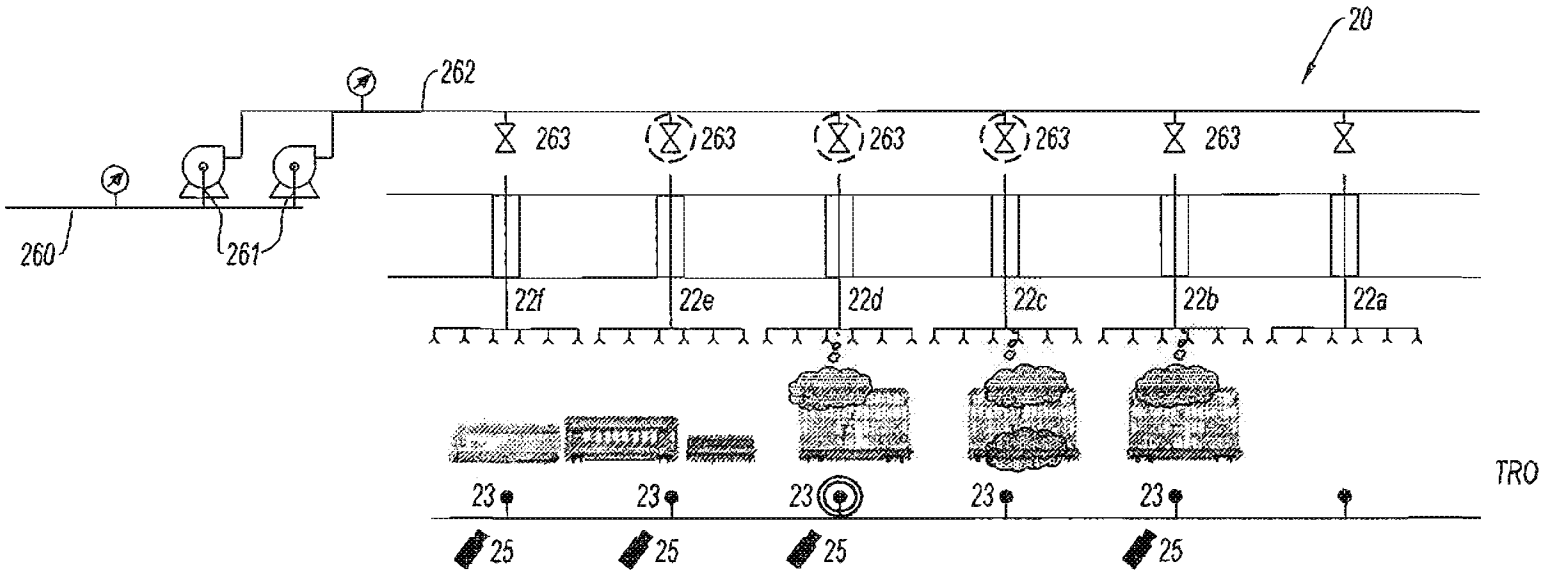
Figure 4:
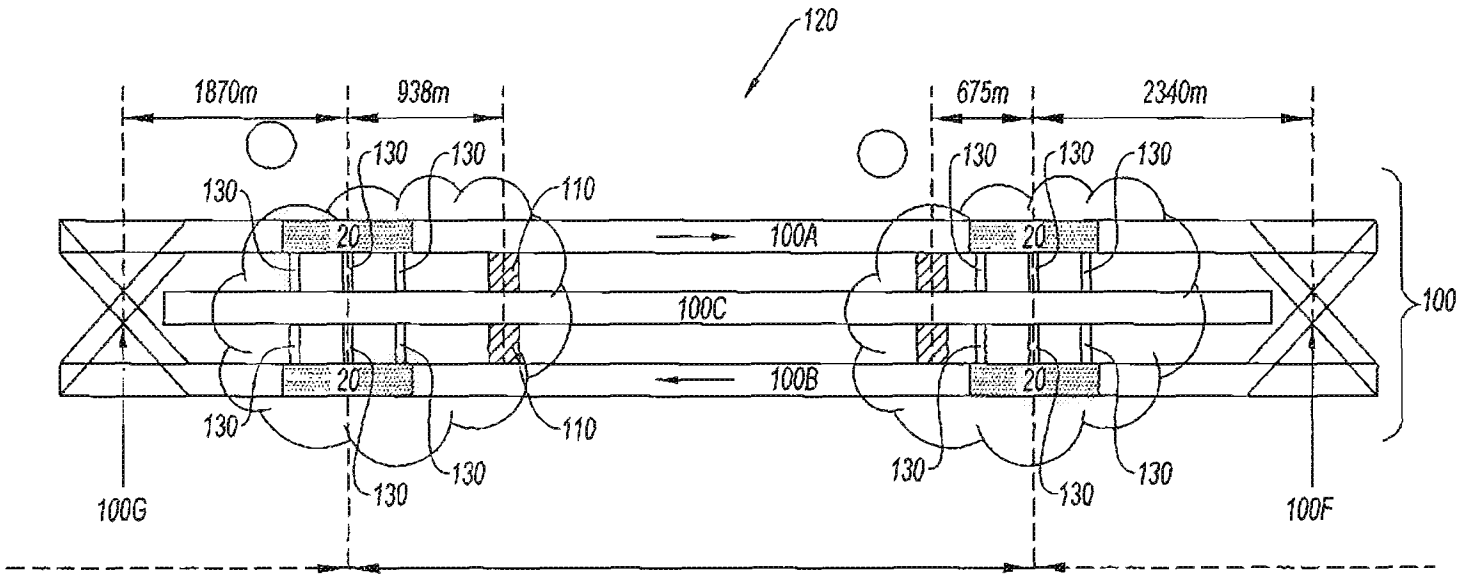

The present invention will be described in further detail below with reference to the accompanying drawings, in which:

FIG. 1 is a diagrammatic view of equipment according to the invention for controlling a train fire in a long railway tunnel, FIG. 2 is a diagrammatic plan view of a tunnel segment equipped with equipment according to the invention, FIG. 3 is a diagrammatic view of a tunnel segment such as the segment of FIG. 2 showing the implementation of the equipment for controlling a fire, FIG. 4 is a diagrammatic plan view of a tunnel segment with two running tubes and a service tunnel equipped with four extinguishing stations of equipment for controlling a fire according to the invention.

DESCRIPTION OF EMBODIMENTS OF THE INVENTION

In accordance with FIG. 1, the invention relates to equipment for controlling a train fire in a long railway tunnel, in particular a train such as a shuttle transporting heavy goods vehicles. The railway tunnel is shown by its track 100 on which the trains TR or shuttles run in a certain direction (arrow d). Such a tunnel 100 generally comprises two tubes 100A, 100B, one for each direction of travel in the outward and return directions. These tubes are generally combined with a service tunnel 100C through which the fluid ducts and electrical supply pass, as well as service personnel and where necessary service vehicles.

In accordance with FIG. 2, the service tunnel 100C is generally located between the two running tubes 100A, 100B and communicates with them via access passages 110 and boreholes 110*a*. The passages 110 enable access to the tubes for maintenance work and also act as emergency exits for the evacuation of passengers from a stopped train to a secure area formed by the service tunnel or protected areas to which the service tunnel provides access. The access passages 110 are normally closed in order to isolate each of the tubes.

According to the general presentation of the invention (FIG. 1), each tube 100, depending on its length, is provided with at least one set of equipment 120 for controlling a fire in a train or part of a train; this equipment 120 is distributed over the course of each tube 100, 100A, 100B as a function of security considerations so that a train TR0 in which a fire has been detected can reach the active part 20 of the equipment in which the fire is treated (extinguished). If, as a result of a stopping distance which is too short, the detected train TR0 cannot stop in the first active part 20 that it encounters, it is driven according to the procedure described below to the following active part 20 of the equipment. The movement of the train TR0 on which a fire has been detected takes place in compliance with safety imperatives and at a reduced running speed known in accordance with the invention as the safety speed Vs which stops the source of the fire from developing further. It is only on approaching the active part 20 of the equipment, in the stopping area ZA, that the train TR0 drops below this safety speed Vs in order to stop.

The equipment 120 is composed overall of equipment disposed throughout the tunnel 100 (i.e. each of the tubes 100A, 100B), equipment on board the trains TR and active parts 20 distributed in a spaced manner in the tunnel; the assembly is managed by a control centre 30 and, where necessary, by decentralized controls associated with each active part 20 or group of active parts which may take over locally from the control centre 30.

The control centre 30, generally outside the tunnel, is combined with at least one active part 20, generally the assembly of the active parts 20 of a tube 100A or 100B or, more generally, all the tubes, i.e. the tunnel 100.

In more detail, in FIG. 1, the equipment comprises a set of fixed detectors 10 distributed along the whole of the track in railway tunnels and whose individual position is known, and an active part formed by an extinguishing station 20 preceded upstream by a stopping area ZA in the direction of travel of the trains (arrow d). A train TR is shown running along the track in the direction of the arrow (d).

The tunnel 100 is equipped with controlled ventilation systems in order to manage the air circulation in the tunnel so as to control the flow of smoke and protect passengers' safety.

The extinguishing station 20 is a tunnel area whose length L is at least equal to the length of a train or the maximum length of trains or shuttles running in the tunnel 100, increased by safety distances. The station 20 has an actual reference point P0 at which the train TR0 has to stop in the event of an incident. The station 20 is provided with extinguishing equipment 21 formed by extinguishing devices 22*a, b, c*, such as rails for spraying extinguishing fluid, for instance water whether or not containing an extinguishing agent, at high pressure and producing a mist of water. Water curtains located at the front, centre and rear of the station may be used. The extinguishing equipment 21 is also equipped over its entire length with detectors 23 making it possible precisely to locate the site of the source of the fire in the train and enable the extinguishing devices 21*a, b, c*, to be controlled independently so as to treat the part of the train which is on fire and its surrounding areas.

The equipment 120 is provided with a control centre 30 common to a plurality of extinguishing stations 20. The control centre 30 is connected to the fixed detectors 10, and to the detectors 23 of the extinguishing station 20 in order to receive the fire signals S10, S23 transmitted by the detectors, compare them with one another and with reference thresholds or models in order to cheek whether a fire or an incipient fire is plausible and manage the running of the trains upstream and downstream of the detected train TR0 on which there is a fire and also to control the detected train TR0 so that measures to extinguish the fire can be taken.

The control centre 30 is connected to the extinguishing equipment 21 in order first to control the preparation of the station 20 before the arrival of the train so that the extinguishing station starts the extinguishing operation as soon as the train stops in it.

The control centre 30 manages the whole running of the train TR0 on which there is a fire by controlling, via its driver, its running speed lie and slowing the train down to the safety speed Vs. This speed Vs is set at a level such that the fire can develop and propagate only slowly so that the train can reach the next extinguishing station 20.

The safety speed Vs is a lower limit speed below which the train TR0 must not run so as not to promote the development of the fire. Above this safety speed Vs, the fire source may be stirred up by the circulating wind. The same applies below this safety speed. The safety speed is obtained by tests or modelling.

The speed must be reduced as the piston relief ducts have to be closed to prevent smoke from passing from one tunnel to the next.

Running at the safety speed Vs continues before entering the extinguishing station 20 and the train stops after a phase of deceleration in the stopping area, moving, from the safety speed Vs to the zero speed, i.e. until it stops. Management of the running of the train also takes account of the speeds normally imposed on the journey. Although the stopping area ZA is situated upstream of the extinguishing station 20 it extends in practice up to the stopping point P0 of the train in the station 20.

The extinguishing station 20 is also equipped with a local control 24 enabling the control centre 30 to be replaced in the event of an incident or in order directly to manage the extinguishing operations in situ, for instance if firefighters are called.

The condition of the train TR0 in the extinguishing station 20 is monitored not just by the detectors 23, but also by cameras 25, in particular infrared cameras transmitting images to the control centre 30 and/or to the local control 21 directly or via the control centre 30.

The detectors 10 along the track in railway tunnels detect flames, smoke or carbon monoxide CO. These detectors are also provided in the extinguishing stations 20.

The information transmission links between the fixed detectors 10 of the tunnel and those 23 of the extinguishing station 20 are provided by cables and in particular by a bus. The link between the control centre 30 and the trains TR is provided by radio.

The extinguishing equipment 21 is supplied with extinguishing fluid by a supply system 26 formed by tanks, pumps and branch lines from a water distribution network. These means are shown diagrammatically by a circle.

With respect to the highly simplified diagram of the equipment 120, the lower portion of FIG. 1 shows the speed profile of a train TR0 upstream of an extinguishing station 20; after detection of a fire on board (flames, smoke, CO), the curve shows a transition from the running speed Vc to the safety speed Vs, then after a section at the safety speed Vs and arrival in the stopping area ZA, the reduction of the speed until the train stops in the extinguishing station 20.

FIG. 2, partially described above, shows part of a tunnel 100 comprising two tubes 100A, 100B though which trains run in one direction and in the other direction, and an intermediate service tunnel 100C.

FIG. 2 also shows the spaces 100D, 100E between these three parts of the tunnel. These spaces are equipped with technical rooms which are either technical rooms 110 or boreholes 100*a* for the passage of the pipe arches and the passage of the ducts 221*a, b, c*, connected to the spray rails 22*a, b, c*.

The boreholes are provided in existing tunnels using civil engineering techniques.

The installation example shown in FIG. 2 is interesting as it shows the combination of two extinguishing stations 20, 20' in the form of a twinned assembly situated at the same point (kilometric point) in the tunnel which makes it possible to simplify the supply of extinguishing fluid 26 by common means such as branch lines 260 from a water distribution network, supply pumps 261 and a collector manifold 262 connected by electrovalves 263 to the ducts 221*a, b, c*, themselves connected to the rails 222*a, b, c*.

The stations 20, 20' are also equipped as mentioned above with detectors 23 and cameras 25 distributed over the length L of the station.

The diagram of FIG. 3 shows an example of a train TR0 in which a fire has been detected and which is now in the extinguishing station 20. The detector 23 has precisely located the source of the fire which has broken out in a lorry. The control centre has activated the rails 22*e* and 22*c* on either side of the fire source and the rail 22*d* facing the fire source so as to confine the fire to a small length of track.

FIG. 4 shows a practical example of equipment of the type shown in FIG. 2, in which the tunnel 100 comprises two tubes 100A, 100B and a service tunnel 100C.

The train tunnels 100A, 100B are connected by junctions 100F, 100G so that trains can pass from one tunnel to the other so that a tube segment may be shut down for works or other reasons.

The two tubes 100A, 100B are each equipped with two stations 20 on the track segment which represents some ten to fifteen kilometers.

The tubes 100A, 100B and the service tunnel 100C are connected by access passages 130. The technical rooms hear the reference numeral 110.

The extinguishing stations 20 are structured in the manner described above and the detectors installed in the tubes along the tracks are not shown.

FIG. 4 also gives dimensional information in meters.

The other means are not shown in this general example.

LIST OF TERMS

10 Fixed detectors
20 Fixed extinguishing station
21 Extinguishing equipment

22*a, b, c* Spraying devices/rails
23 Fire detectors
24 Control post
25 Cameras
30 Control centre
40 Ventilation system
100 Tunnel
100A, 100B Train running tubes
100C Service tunnel
100D, 100E Spaces
100F, 100G Track junctions
110 Technical rooms
110*a* Borehole
120 Extinguishing equipment
130 Access posts/passages
221*a, b, c* Duct passages
TR Train
TR0 Detected train
ZA Stopping area
Vc Running speed
Vs Safety speed
d Direction of train running
P0 Reference point
S10, S23 Fire signals
L Length of a train TR

The invention claimed is:

1. Equipment for controlling a train fire in a long railway tunnel, comprising:

a set of fixed fire detectors installed along the tunnel;

a set of detectors installed on board trains;

at least one fixed extinguishing station, installed in the tunnel over a length at least equal to the length of a train, and comprising:

extinguishing equipment with devices for spraying an extinguishing fluid, these devices being individually controlled and distributed over the length of the extinguishing station, and a set of fire detectors installed along the station and operative to detect a position of a fire in a detected one of said trains;

a train stopping area, upstream of the extinguishing station, in which in use the detected train slows down to its zero speed so that it can be stopped in a predetermined precise position in the extinguishing station;

a control center, connected to the fixed fire detectors and to the fire detectors of the extinguishing station to receive fire signals therefrom and operative to:

monitor fire information by reconciling the fire signals received, order a reduction of the speed of the detected train from its normal running speed to a reduced safety speed, order the detected train to stop in the extinguishing station, including ordering the train to start a stopping sequence on entering the stopping area and to stop the train in the predetermined precise position in the extinguishing station, detect after the train stops, using the set of fire detectors installed along the extinguishing station, a position of the fire in the selected train, automatically configure the extinguishing fluid spraying devices with respect to the detected position of the fire and surrounding areas in the extinguishing station, and command spraying by the extinguishing fluid spraying devices to commence as soon as the train stops.

2. Equipment according to claim 1, comprising a plurality of said fixed extinguishing stations spaced apart along the tunnel and separated by lengths of tunnel not equipped with said extinguishing equipment, and wherein stopping in the extinguishing station comprises stopping in a next available one of the plurality of extinguishing stations.

3. Equipment according to claim 1, comprising a ventilation system for the tunnel, wherein the control center is operative to control the ventilation system in order to manage flows of air upstream and downstream of the detected train.

4. Equipment according to claim 1, wherein in the extinguishing station the extinguishing fluid is sprayed in the form of a mist over the detected position of the fire and the surrounding areas, and wherein the extinguishing station further comprises curtains of water situated at the front and the rear of the predetermined position of the train and a third curtain of water situated at a center of the extinguishing station that can be activated by remote or local control.

5. Equipment according to claim 4, wherein the extinguishing fluid is water containing an added extinguishing agent.

6. Equipment according to claim 1, wherein the extinguishing station is equipped with a plurality of extinguishing fluid spray rails, each rail belonging to an extinguishing device that is separately controlled in order to spray extinguishing fluid only on the fire and the areas surrounding the fire.

7. Equipment according to claim 1, wherein the fire detectors in the extinguishing station comprise detectors and cameras to detect the position of the fire in the train and supply a camera image of the fire.

8. Equipment according to claim 7, wherein the camera image of the fire is an infrared camera image.

9. Equipment according to claim 1, wherein the tunnel comprises two tubes in which in normal use trains run in opposite directions, and wherein the two tubes are equipped at substantially the same location with said extinguishing stations, and wherein the extinguishing stations are operative independently of a direction in which the trains are running in each of the tubes.

10. Equipment according to claim 1, further comprising a manual decentralized control post in a vicinity of an extinguishing station so that the control of the extinguishing systems may be taken over directly by manual intervention.

11. A method for controlling a train fire in a long railway tunnel wherein the tunnel comprises at least one fire extinguishing station equipped with extinguishers spaced apart along the station, comprising:

detecting trains are as they pass in front of fire detectors;

if a fire is detected on a detected one of the trains, monitoring from a control position a fire signal transmitted by the fire detectors;

from the control position, ordering the driver of the detected train to travel at a set safety speed that is lower than a normal running speed and that stabilizes the fire; after the train has started to run at the safety speed, ordering the driver to stop the train at said fire extinguishing station; and after the train has stopped in the extinguishing station: detecting a position of the fire along the train;

automatically pre-configuring areas along the train to be extinguished; and activating the extinguishers of only the pre-configured areas of the extinguishing station.

12. A method according to claim 11, wherein the at least one fire extinguishing station comprises a plurality of fire extinguishing stations spaced apart along the tunnel and separated by lengths of tunnel not equipped with extinguishers, and wherein to stop the train at said fire extinguishing station comprises to stop the train at a next available one of said plurality of fire extinguishing stations.

* * * * *